United States Patent [19]

Werth et al.

[11] Patent Number: 4,464,000

[45] Date of Patent: Aug. 7, 1984

[54] ELECTRICAL CONNECTOR ASSEMBLY HAVING AN ANTI-DECOUPLING DEVICE

[75] Inventors: Dee A. Werth, Afton; Vincent A. Luca, Jr., Sidney, both of N.Y.

[73] Assignee: The Bendix Corporation, Southfield, Mich.

[21] Appl. No.: 431,992

[22] Filed: Sep. 30, 1982

[51] Int. Cl.[3] ..... H01R 13/629

[52] U.S. Cl. ..... 339/89 M; 339/DIG. 2

[58] Field of Search ..... 339/DIG. 2, 89 R, 89 C, 339/89 M, 90 R, 90 C; 285/81

[56] References Cited

U.S. PATENT DOCUMENTS

| | | | |
|---|---|---|---|
| 3,390,900 | 7/1968 | McCormick et al. | 285/81 |
| 3,830,957 | 8/1974 | Oberdiear | 339/89 R |
| 3,835,443 | 9/1974 | Arnold et al. | 339/90 R |
| 4,255,008 | 3/1981 | Snyder et al. | 339/89 M |
| 4,355,854 | 10/1982 | Williams | 339/89 R |

FOREIGN PATENT DOCUMENTS

| | | | |
|---|---|---|---|
| 233641 | 3/1960 | Australia | 339/89 C |
| 45038 | 2/1982 | European Pat. Off. | 339/89 C |

*Primary Examiner*—John McQuade

*Attorney, Agent, or Firm*—C. D. Lacina; R. J. Eifler

[57] ABSTRACT

An electrical connector assembly of separable first and second shells (100, 200) and a coupling nut (300) having a radial flange (340) rotatably mounted about first shell (100) and rearwardly of an annular shoulder (140) thereof with a coil spring (500) and an annular ring (400) mounted for sliding disposed between flange (340) and shoulder (140) for resisting unwanted rotation. Annular shoulder (140) and annular ring (400) have frustoconical tapered faces (150, 420) to define therebetween a Vee-shaped vise for longitudinally squeezing the coil spring (500) and camming the spring radially outwardly from snug contacting fitment with the shell (100) and against an inner wall (322) of the coupling nut whereby frictional contact spring (500) against itself and portions of the coupling nut (300) resist rotation.

10 Claims, 5 Drawing Figures

ELECTRICAL CONNECTOR ASSEMBLY HAVING AN ANTI-DECOUPLING DEVICE

This invention relates to an electrical connector assembly having an anti-decoupling device and more particularly to a rotatably mounted coupling nut and a tapered ring adapted to laterally squeeze an annular coil spring and transversely drive the spring annulus radially outwardly against a wall of the coupling nut whereby friction between collapsed coils and contacted connector walls resist uncoupling rotation of the coupling nut.

An electrical connector assembly comprises a plug connector telescopically interfittable with a receptacle connector for mating and a coupling nut rotatably mounted to the plug connector being adapted for threaded engagement with the receptacle connector whereby the connectors may be drawn together into a mated relation in an axial motion without relative rotation by rotation of the coupling nut in a coupling direction. In the use of such coupling nuts, uncoupling rotation of the coupling nut is typically essential inasmuch as this enables disassembly of the connector members. There has been a need for making certain that the coupling nut does not backoff under vibration or other forces.

An exemplary device having means for resisting unwanted uncoupling rotation is disclosed in "Electrical Connector Having an Anti-Decoupling Mechanism," U.S. Pat. No. 4,109,990 issuing Aug. 29, 1978 to Waldron et al wherein a chordal spring beam including a medial tooth is mounted to the coupling nut to coact with a plurality of ratchet teeth disposed around a shoulder of the plug connector. Use of such springs and coacting ratchet teeth requires that mating parts have close tolerances to provide efficient and sure contact therebetween. Wearing of the ratchet teeth and/or the spring element can be troublesome following repeated coupling/uncoupling. Generally, to increase the resistance to rotation, a plurality of like spring beams are provided which results in additional cost in fabrication of the springs and fixation of the springs about the coupling nut.

An anti-decoupling device described in "Electrical Connector Assembly Having Anti-Decoupling Device," U.S. Pat. No. 4,255,008 issuing Mar. 10, 1981 to Snyder provides stop members on the coupling nut and bosses on the plug shell to interact with coils of a helical spring disposed therebetween to constantly and consistently resist rotation between the coupling nut and the connector body. Provision of the stop members and bosses results in additional fabrication costs but does not eliminate a requirement of close manufacturing tolerances to assure engagement with the coil spring.

In accordance with this invention there is provided an electrical connector assembly having an antidecoupling device comprising: a first shell having an annular shoulder; a second shell having thread on an outside portion thereof; a coupling nut mounted for rotation about the first shell for connecting and maintaining the shells together and holding a set of contacts mounted in one shell mated with a mating set of contacts in the other shell and an anti-decoupling device for retarding the rotational movement of the coupling nut relative to the first shell, the coupling nut having an inner wall, an inward radial flange and including thread on the inner wall connectable with the external thread on the second shell for connecting the shells together with the contacts therein held in mated relationship. In accord with this invention the anti-decoupling device comprises an annular sliding ring and an annular coil spring disposed between the radial flange and the annular shoulder, the sliding ring having an end face abutting the flange and a forwardly tapered surface confonting the coil spring, the annular coil spring being formed by a helical coil having its opposite ends formed into a continuous loop or annulus and fitted about the connector shell in a snug, slightly extensed fit, the annular coil spring confronting the tapered surface and abutting the annular shoulder about the connector shell whereby as the coupling nut is rotatably advanced to complete a connection, the tapered surface of the sliding ring laterally squeezes against the coil annular spring and cams the coil spring radially upwardly and outwardly from contact with the connector shell, thereby collapsing the coils into a generally elliptical shape, the coil spring ultimately being uniformly biased against the inner wall of the coupling nut and against the tapered surface of the sliding ring and the annular shoulder of the connector. To enhance upward camming of the coil spring, the annular shoulder includes a rearwardly tapered surface, the forward and rearward tapered surfaces cooperating to define a V-shaped vise which closes about the spring.

One advantage of this assembly is provision of an efficient anti-decoupling device that requires few parts, uses parts which are both inexpensive and easy to manufacture and is assembled with only a minimum of manufacturing steps. More particularly an advantage of the present anti-decoupling device wherein a helical coil spring is driven against the coupling nut resides in the ability to lock plug receptacle connector shells together only when the coupling nut approaches full mate with the receptacle connector thereby eliminating wear and friction between the anti-decoupling parts. In addition, strict manufacturing tolerance requirements between the mating components are eliminated by the present invention wherein a coil spring is snugly positioned completely about the plug connector.

One way of carrying out the invention as described in the detail below with reference to the drawings which illustrate one specific embodiment of this invention, in which.

Figure 1:
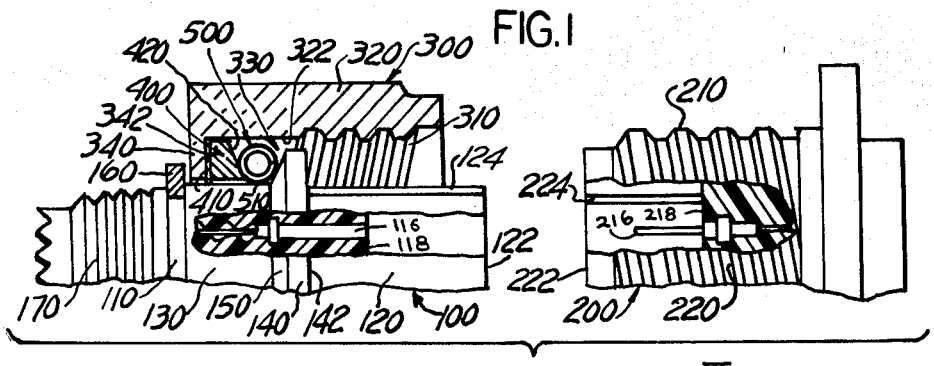
FIG. 1 is a partial section view of an electrical connector assembly having a coupling nut and means for resisting uncoupling rotation.

Referring now to the drawings, FIG. 1 shows an electrical connector assembly according to the present invention which includes a first shell 100, a second shell 200 and a coupling nut 300 rotatably mounted on first shell 100 for connecting the first and second shells 100, 200 in mating relationship and an antidecoupling device for resisting unwanted uncoupling of the coupling nut. First shell 100 is a plug connector and includes a cylindrical front portion 120 having a front face 122, a rear portion 170 having a stepped groove 110 and an annular wall 130 and an annular shoulder 140 medially of the shell portions, annular shoulder 140 having a forward face 142. Typical components of the plug connector include one or more female-type (i.e., socket) electrical contacts 116 retained by a dielectric insert 118 mounted therewithin and one or more keys 124 on the outer surface of the front portion 120 for orienting the first shell relative to the second shell.

Second shell 200 is a receptacle connector including a cylindrical front portion 220 having a front face 222 and external thread 210, front portion 220 being sized to telescope about front portion 120 of plug shell 100 and advance forwardly thereabout so that front face 222 thereof is abutting forward face 142 of annular shoulder 140 when fully mated. Typical components of the receptacle connector include one or more axially extending recesses or keyways 224 for receiving the respective keys 124 on shell 100 and one or more male type (i.e., pin) electrical contacts 216 that mate with socket contacts 116, the pin contacts being retained by a dielectric insert 218 carried therewithin.

The coupling nut 300 is adapted to be received over the rear portion 170 of plug shell 100 and comprises an inwardly extending radial flange 340 having an end wall 342 and a tubular hood 320 having an annular inner wall 322 and including internal thread 310 adapted to mate with the external thread 210 on receptacle shell 200, the coupling nut being rotatably mounted thereto by a retaining ring 160 received in stepped groove 110 captivating radial flange 340 adjacent annular shoulder 140. Engagement between thread 210, 310 and rotation of coupling nut 300 axially draws the first and second shells 100, 200 together with the contacts 116, 216 mated.

An annular cavity 330 is defined by radial flange 340, inner wall 322, annular shoulder 140 and annular wall 130, inner wall 322 circumposing annular wall 132.

Preferably and in accord with this invention, an annular slide ring 400 and an annular coil spring 500 are disposed in annular cavity 330, annular coil spring 500 being a helical coil having its ends secured and thereby formed into a continuous loop and positioned adjacent annular shoulder 140 of shell 100. Annular sliding ring 400 is clearance fit about annular wall 130 and includes a flat end face 410 and a frusto-conical forwardly tapered surface 420 adapted, respectively, to be abutted against end wall 342 of radial flange 340 and annular coil spring 500, the annular coil spring being snugly fitted about annular wall 130 wherein individual coils thereof are slightly extensed. Preferably and in accord with this invention, annular shoulder 140 would include a frusto-conical rearwardly tapered surface 150 to abut coil spring 500.

Figure 2:
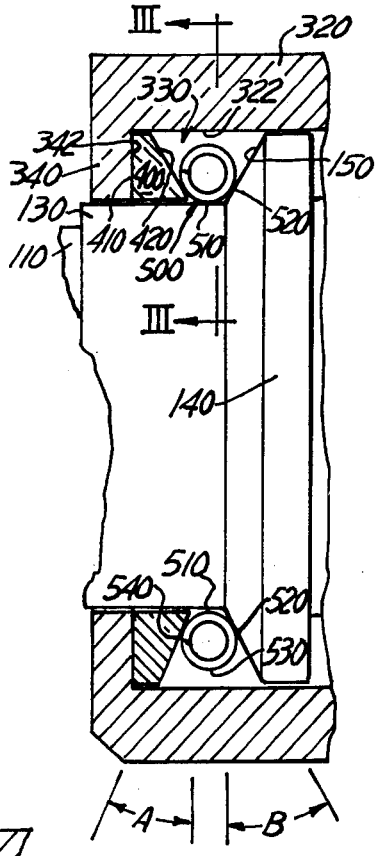
FIG. 2 is an enlarged partial section view of FIG. 1 showing detail of the coupling nut positioning a helical spring adjacent an annular ring.

FIG. 2 shows annular coil spring 500 snugly secured about first shell 100 and sandwiched longitudinally between and in abutting relation with the frusto-conical, forwardly and rearwardly tapered surfaces 420, 150, respectively, of annular sliding ring 400 and annular shoulder 140. Although coil spring 500 is slightly extensed to be snugly fit about annular wall 130, this is the "relaxed" position of the coil spring. That is, inner wall 322 of coupling ring 300 is not contacted by coil spring 500. Annular sliding ring 400 is clearance fit for sliding around annular wall 130 of first shell 100 and inner wall 322 of coupling nut 300.

Tapered surface 420 forms a continuous forwardly facing frusto-conical surface disposed at an angle "A" relative to a plane perpendicular to the axis of rotation of the coupling nut. Preferably, angle "A" would be between 30° and 45°. Similarly, tapered surface 150 forms a continuous, rearwardly facing frusto-conical surface disposed at an angle "B" relative to a plane perpendicular to the axis of rotation of the coupling nut. Preferably, angle "B" would be between 30° and 45°. The forward and rearward tapered surfaces 150, 420 form a continuous Vee-shaped vise which axially closes about the coil spring. Preferably, the total combined angle between surface 150, 420 forming the Vee angle would be about 60°, depending, respectively, on the angles "A" or "B" on the tapered surfaces 150, 420.

Figure 3:
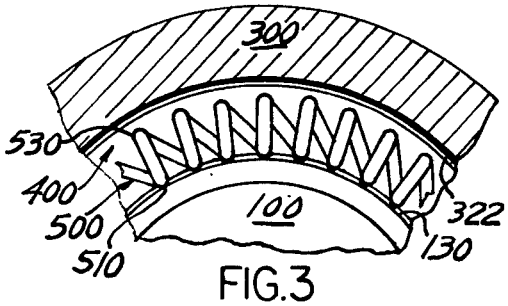
FIG. 3 is a partial section view of the coupling nut taken along lines III—III of FIG. 2 and the spring in its relaxed condition.

FIG. 3 shows an end view of coil spring 500 in its "relaxed state" wherein the coils are slightly extensed around the first shell 100 and slightly "canted" as a result of their snug fit about annular wall 130 of the connector. Coil ends 510 are in contact with wall 130 and coil ends 530 are out of contact with inner wall 322.

Figure 4:
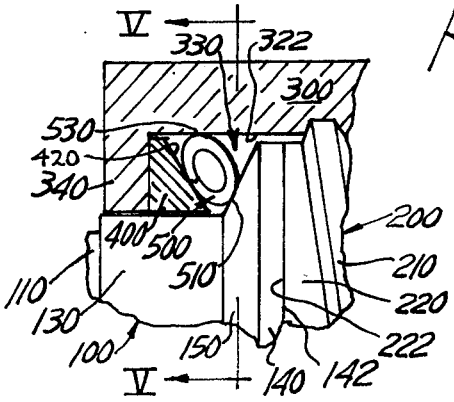
FIG. 4 is a partial section view, similar to FIG. 1, showing the assembly at full-mate and in a locked relation with the spring in a distorted condition.

FIG. 4 shows the result of coupling nut rotation. Tapered surfaces 150, 420 have advanced towards one another to laterally squeeze coil spring 500 captivated therebetween to drive the coil annulus radially outwardly from contact with annular wall 130 and against inner wall 322 of the coupling nut, contact between coil ends 530 and inner wall 322 increasing sliding friction to resist rotation.

Figure 5:
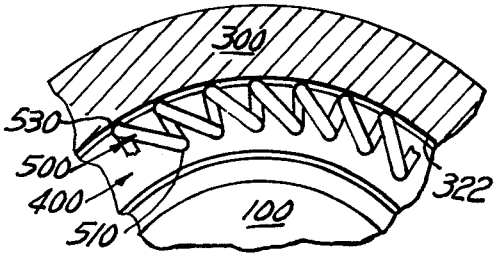
FIG. 5 is a partial section view of the coupling nut and the assembly at full-mate, similar to FIG. 3, taken along lines V—V of FIG. 4.

FIG. 5 shows an end view of the coupling nut 300 and plug shell 100 and the annular coil spring in its distorted or squeezed condition and locking the connector nut and plug shell together.

In operation, rotation of coupling nut 300 in the coupling direction advances radial flange 340 and end wall 342 thereof against end face 410 of annular sliding ring 400 to drive the sliding ring longitudinally forward relative to annular wall 130 and against annular coil spring 500, whereupon the coil spring abuts against tapered surface 420 and tapered surface 150. Continued rotation and axial advance of coupling nut 300 causes continued "vise-like" squeezing by the tapered surfaces against the coil spring, causing individual spring coils to "cant" more severely (i.e., to distort) and assume an elliptical cross section. The coils in being distorted from the generally cylindrical shape and into the elliptical shape are somewhat flattened and collapsed one on top of the other. Further rotation of the coupling nut causes inner coil ends 510 contacting annular wall 130 of first shell to be driven from snug abutment thereagainst and radially outwardly therefrom and, ultimately causes outer coil ends 530 to be driven into abutment with inner wall 322 of the coupling nut. When coil spring 500 is in its fully distorted or squeezed condition, a lock situation results wherein the coupling nut and the first shell will not easily undergo uncoupling rotation due to the frictional resistance of the coils against the surfaces contacted including coil-to-coil, coil ends against tapered surfaces 150, 420 and coil ends against inner wall 322.

Although the description of this invention has been given with reference to a particular embodiment, it is not to be construed in any limiting sense. Many variations and modifications may occur to those skilled in the art. Forwardly tapered surface 420 could be integral with coupling nut 300 instead of being provided on separate annular annular slide ring 400. Instead of rearwardly tapered surface 150 being integral with annular shoulder 140 of the first shell 100, a separate ring like slide ring 400 could be used. A single contoured surface forming a V-shape could replace the pair of tapered surfaces forming a V-shape. Further, although helically engaged thread are shown, it is to be understood that equally similar results would be achieved by utilization of a bayonet-type locking engagement.

We claim:

1. An electrical connector assembly having an anti-decoupling device comprising: first and second shells (100, 200), said first shell (100) having an annular wall (130) circumjacent an annular shoulder (140); a coupling nut (300) having an inner wall (322) and an end wall (342) rotatably mounted to said first shell (100) and including thread (310) connectable with corresponding thread (210) on the second shell (200) for interconnecting the shells, a spring cavity (330) being formed between end wall (342) and annular shoulder (140) and between annular wall (130) and inner wall (322); and an anti-decoupling device for retarding rotational movement of the coupling nut (300) relative to the interconnected shells, said anti-decoupling device characterized by:

an annular ring (400) clearance fit for sliding about first shell (100) and having and end face (410) in abutment with end wall (342) and a forward tapered face (420); and a helical coil spring (500) formed into an annulus and disposed within spring cavity (330), the inner surfaces of each coil of the spring being snugly fit about annular wall (130), coupling rotation advancing end wall (342) longitudinally forward against annular ring (400) and forward tapered face (420) thereof into abutment with coil spring (500) to squeeze the coil spring into abutment with annular shoulder (140) and cam the annulus radially from snug contact with annular wall (130) upwardly against inner wall (322) of the coupling nut, friction developed between coils squeezed together and squeezed against inner wall (322), tapered face (420) and annular shoulder resisting rotation of the coupling nut.

2. An electrical connector as recited in claim 1, characterized in that annular shoulder (140) on first shell (100) includes a rearwardly tapered face (150), the tapered faces (150, 420) forming a Vee-shaped annulus between which the annulus of the coil spring (500) is fitted.

3. An electrical connector as recited in claim 1 or 2 wherein forwardly tapered face (420) on annular ring (400) is defined by an angle of between 30° and 45° relative to a plane perpendicular to the axis of rotation of the coupling nut.

4. An electrical connector as recited in claim 2 wherein rearwardly tapered face (150) on annular shoulder (140) is defined by an angle of between 30° and 45° relative to an axis perpendicular to the axis of rotation of the coupling nut.

5. An electrical connector as recited in claim 2 wherein the combined angle forming the Vee-shaped annulus between tapered faces (150, 420) is about 60°.

6. An electrical connector of the type including a first connector (100) having an annular wall (130) and an annular shoulder (140) thereabout; a second connector (200) having thread (210) on the outer surface thereof; a coupling nut (300) disposed on the first connector and including an inward radial flange (340) and thread (310) on an inner wall (322) thereof, the connectors (100, 200) being interconnected upon rotation of the coupling nut (300) to threadingly engage the respective thread (210, 310) and pull the connectors (100, 200) together along their central axis, and locking means for resisting unwanted uncoupling rotation of the coupling nut (300), said locking means characterized by:

an annular coil spring (500) snugly fit and slightly extensed around annular wall (130) of first connector (100); and means (150, 420) defining a laterally closing vise for squeezing the coil spring against the inner wall (322) of the coupling nut, said squeezing means including a frusto-conical face (420) associated with said coupling nut being adapted to be brought into abutment with the spring annulus, rotation of coupling nut (300) causing the vise to deform each of the spring coils and the frusto-conical face (420) to drive the coil annulus radially outwardly and into abutting relation against the inner wall (322) of the coupling nut (300), said squeezing deformation of the annular coil spring flattening adjacent spring coils onto one another and the coil annulus against the inner wall and the frusto-conical face with forces of friction developing as a result of surface contact between the deformed coil spring resisting rotation of the coupling nut from rotating relative to the two connectors.

7. An electrical connector as recited in claim 6 wherein said squeezing means (150, 420) comprises an annular sliding ring (400) disposed in abutment with radial flange (340) and annular shoulder (140) including a second frusto-conical face (150), annular ring (400) including said frusto-conical face (420).

8. An electrical connector as recited in claim 7 wherein the frusto-conical faces (150, 420) describe a Vee-shape into which the coil annulus fits, the Vee defining a combined angle of about 60° between the frusto-conical faces.

9. An electrical connector of the type including:

first and second connector members (100, 200) including matable contacts (116, 216) adapted for connection in electrical engagement, said first connector member (100) having an outer annular wall (130) and an annular shoulder (140) thereabout;

a coupling nut (300) carried by said first connector member for rotation relative thereto and having an inner wall (322) and an inwardly directed radial flange (340);

thread means (210, 310) for inter-engaging said coupling nut (300) and the second connector member (200); and means (400, 500) for resisting unwanted rotation of said coupling nut, said rotation resisting means being characterized by;

an annular ring (400) clearance fit for sliding about annular wall (130) and having forward and rearward faces (410, 420), rearward face (410) being disposed in abutment with radial flange (340) and forward face (420) being tapered to define a frusto-conically shaped surface; and an annular coil spring (500) fit snugly about annular wall (130), said coil spring being disposed in confronting relation with annular shoulder (140) and forward face (420);

coupling rotation of coupling nut (300) advancing flange (340) thereof against annular ring (400) to slide the ring longitudinally forward about annular wall (130) and into abutment with coil spring (500) and the spring into abutment with annular shoulder (140) whereby forward surface (420) squeezes against the coils and cams the coil spring radially outwardly and into abutting relation with inner wall (322) of the coupling nut.

10. An electrical connector according to claim 9 wherein annular shoulder (140) includes a rearward face (150), rearward face (150) being tapered to define a frusto-conically shaped surface, each of the frusto-conical surfaces (150, 420) defining tapered faces for abutting the coil annulus, the pair of frusto-conically shaped surfaces in combination with sliding annular ring (400) defining a Vee-shaped vise for laterally squeezing against coil spring (500).

* * * * *